US005265720A

United States Patent [19]

Meliconi

[11] Patent Number: 5,265,720

[45] Date of Patent: Nov. 30, 1993

[54] SHOCK-PROOF PROTECTIVE JACKET FOR A REMOTE CONTROL UNIT

[75] Inventor: Loris Meliconi, Ganarolo Emilia, Italy

[73] Assignee: Meliconi S.P.A., A Corp. of Italy, Milan, Italy

[21] Appl. No.: 920,687

[22] Filed: Jul. 28, 1992

[30] Foreign Application Priority Data

Dec. 5, 1991 [IT] Italy ..... BO91A000458

[51] Int. Cl.[5] ..... B65D 85/38; B65D 81/02

[52] U.S. Cl. ..... 206/305; 150/165; 206/320; 206/523; 206/592

[58] Field of Search ..... 206/305, 320, 521, 523, 206/586, 592; 150/154, 165

[56] References Cited

U.S. PATENT DOCUMENTS

| | | | |
|---|---|---|---|
| 2,860,768 | 11/1958 | Smithers | 206/523 |
| 3,384,221 | 5/1968 | Houtman | 206/523 |
| 4,733,776 | 3/1988 | Ward | 206/305 |
| 4,762,227 | 8/1988 | Patterson | 206/305 X |
| 4,824,059 | 4/1989 | Butler | 206/523 X |
| 4,836,256 | 6/1989 | Meliconi | 206/523 |
| 4,838,420 | 6/1989 | Collett et al. | 206/523 X |
| 5,092,459 | 3/1992 | Uljanic et al. | 206/320 |

*Primary Examiner*—Bryon P. Gehman

*Attorney, Agent, or Firm*—Fay, Sharpe, Beall, Fagan, Minnich & McKee

[57] ABSTRACT

The protective anti-shock jacket for instruments for personal and professional use, in particular for portable remote control units, is of the structurally monolithic type made in elastomer material, and exhibits in its inferior wall one or more windows or slits destined to reduce tension on the other walls, which tension is relative to the elastic reaction of the material of the elastically deformed jacket, with the insertion of the instrument into the jacket.

17 Claims, 4 Drawing Sheets

SHOCK-PROOF PROTECTIVE JACKET FOR A REMOTE CONTROL UNIT

BACKGROUND OF THE INVENTION

The invention relates to a shock-proof protective jacket, particularly suitable for portable remote control units of televisions, recording instruments and in general remote-control units, such as for example portable telephones, alarm clocks, professional instruments such as calculators, measuring instruments and suchlike. The following description will make special reference to portable remote control units of the above-specified type; the jacket in question, however, may find application also in other types of instrument.

The problem of protecting such remote control units from shocks and bumps has already been dealt with in the art and has been adequately solved by providing a by now well-known jacket which in Italy goes by the trade-mark name of "Guscio TV", produced and sold by the present applicant and object of Industrial Invention Patent No. 1,208,461.

The solution according to the above-mentioned patent solves the problem of remote-control unit protection by providing a jacket in elastomer material having a substantially parallelepiped shape, and having also internal dimensions which are substantially similar to the external dimensions of the instrument to be inserted and protected, the said jacket also being of a thickness which is sufficient to absorb shocks. The realisation of the said jacket, even if it is structured in such a way as to be considerably elastic, has one limitation relative to the need to produce a rather large number of different jackets in order to meet the different size requirements of various remote control units. The applicant felt that the practice of having jackets which are structurally defined according to the requirements of specific shapes of instruments to be protected would be better abandoned in favour of jackets which were each suitable for single units within groups of instruments having quite different shapes.

SUMMARY OF THE INVENTION

The aim of the present invention is therefore to make a jacket in elastomer material with good elastically-deformable characteristics, particularly suitable for remote control units with quite varied shapes, especially, but not exclusively, with regard to their length.

To reach the said aim, the applicant has invented a jacket in one-piece elastically-deformable material, having, in substance, six walls, one of which being superior with at least one large window for the insertion of the instrument and for external access to the said instrument, one inferior, two at the ends and two lateral sides, and having in the said inferior wall, one or more windows or slits to reduce the tension on the said inferior wall and on the other walls, a tension which is due to the reaction of the deformed material to the insertion of the said instrument into the jacket, thus permitting a good adherence of the jacket to the instrument without incurring unwanted deformation of the most stretchable parts of the jacket itself, which would suffer most from such tensions.

BRIEF DESCRIPTION OF THE DRAWINGS

These and other characteristics of the invention will be described in more detail in the description which follows, with the help of the accompanying illustrations which represent some purely exemplary and non-limiting embodiments for portable remote control units, and in which.

DESCRIPTION OF THE PREFERRED EMBODIMENTS

Figure 1:
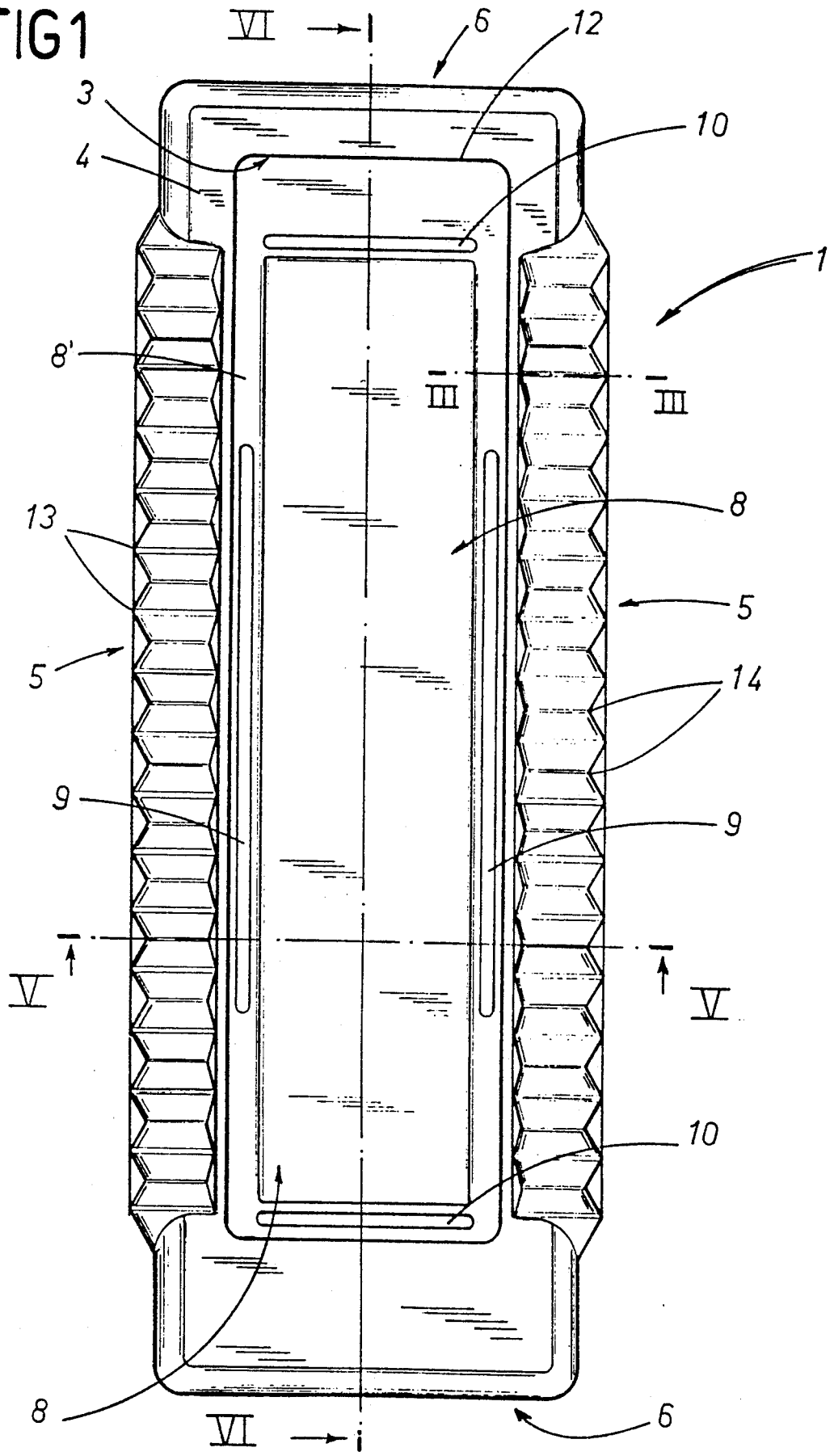
FIG. 1 shows the jacket in plan view.
Figure 2:
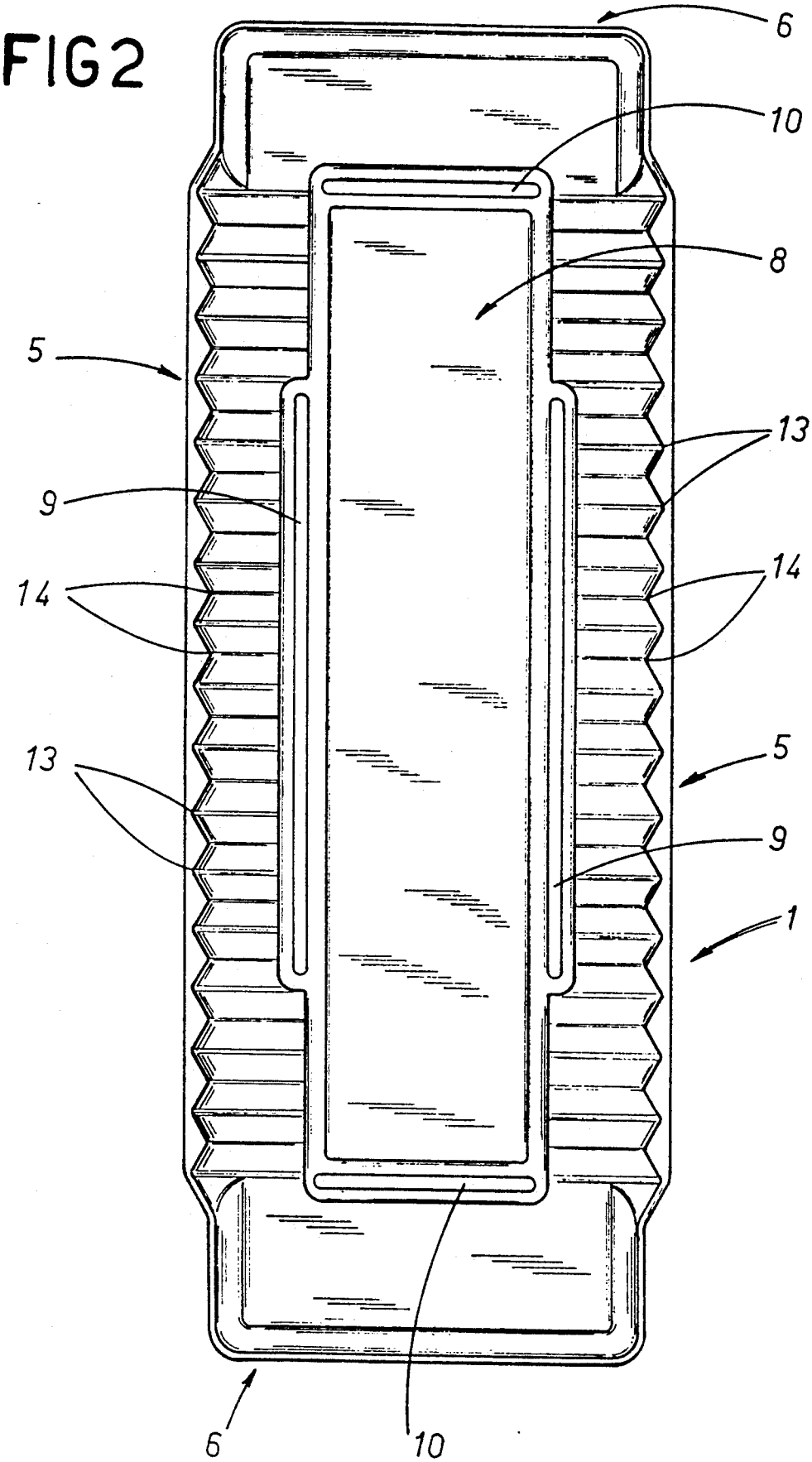
FIG. 2 shows the jacket in a view from below.
Figure 3:
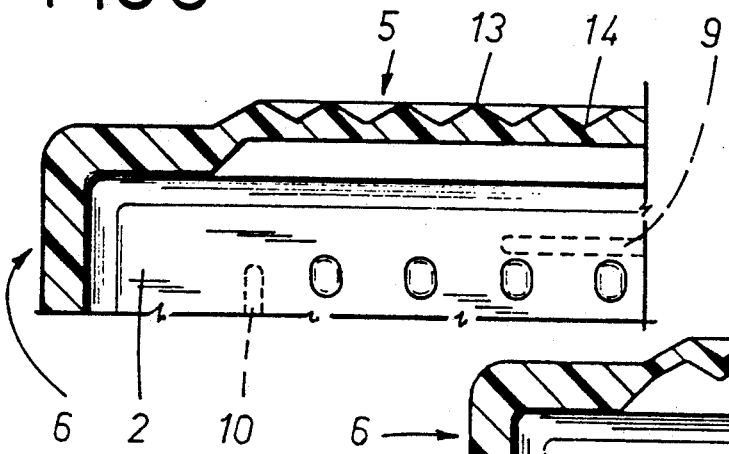
FIG. 3 is a partial horizontal flat section of the jacket passing through axis III—III indicated in FIG. 1 and with the instrument also partially illustrated in inserted position.

With particular reference to FIG. 1, the jacket object of the invention takes the form of a sheath 1 of substantially parallelepiped shape, into which a remote control unit or an instrument 2 can be inserted through an opening 3 made in the jacket's superior wall 4, which superior wall 4 function is also that of permitting user access to the buttons or the operative panel of the instrument housed in the jacket.

Figure 4:
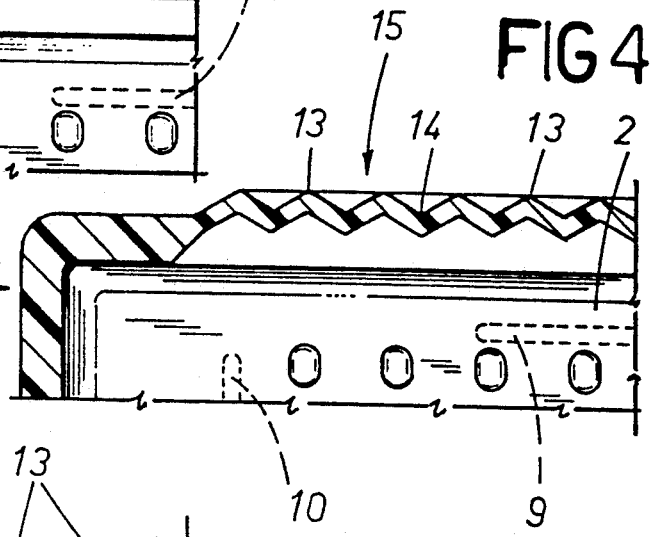
FIG. 4 is a partial horizontal flat section of the jacket passing through line III—III indicated in FIG. 1 and relative to an alternative embodiment of the jacket.

The jacket can be made by forming of an elastomer material, for example a polyeurethane, having considerably elastic characteristics, as indicated hereinafter, and in one or more portions of the lateral walls or sides 5 and of the superior wall 4 and the inferior wall 8 adjoining the sides 5, the sheath or jacket 1 has according to a longitudinal section, areas of greater thickness 13 connected to and alternated with areas of lesser thickness 14. This alternation creates portions of greater elastic compliance for an easier elastic deformation of the jacket 1. Alternatively, as is illustrated in FIG. 4, on the said portions, or in any case comprised between the two ends, the jacket 1 can have a longitudinal section 15 conformed according to a bellows-shape to favour a considerable elastic extension of the jacket 1 in the direction of its longer side.

Figure 5:
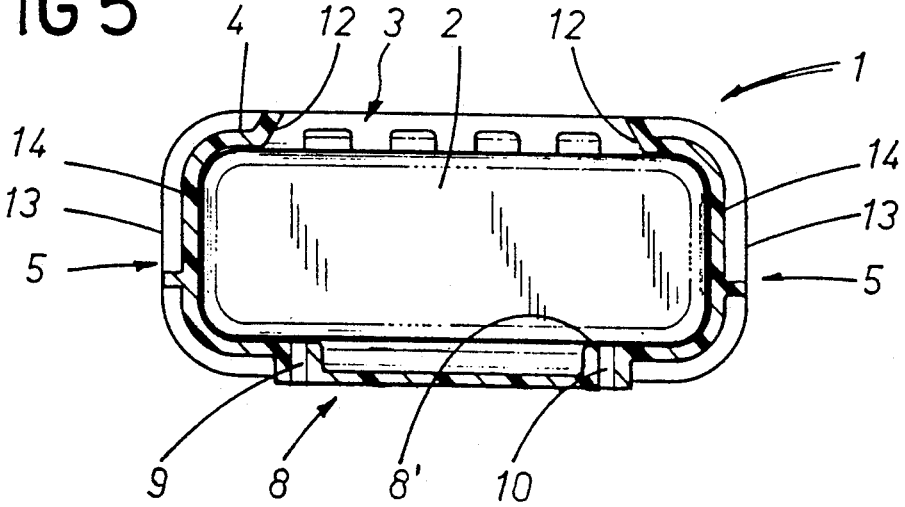
FIG. 5 is a transversal section of the jacket according to section V—V of FIG. 1.

In both cases, and according to a preferred embodiment, at least the internal surfaces of the sides 5 which connect the inferior wall 8 with the covering or superior wall 4 are connected in such a way as to avoid the presence of sharp edges (see FIG. 5).

Furthermore, and in both cases, again according to a preferred embodiment, the said areas of greater thickness or, respectively, the external peaks of the bellows, are more external with respect to the ends of the jacket 1 with the aim of better ensuring the housed instrument protection against lateral shocks.

Figure 8:
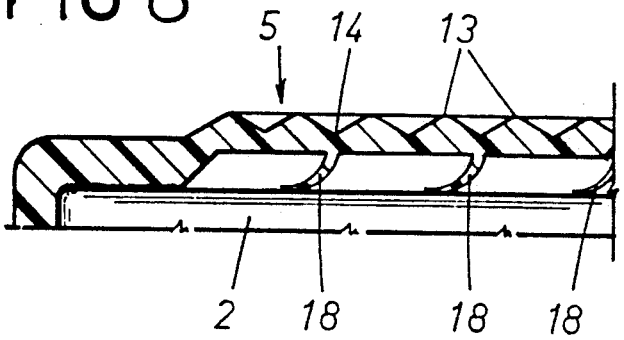
FIGS. 8 and 9 are partial horizontal flat sections of the jacket according to a possible embodiment variant with respect to what is illustrated in FIGS. 3 and 4.
Figure 9:
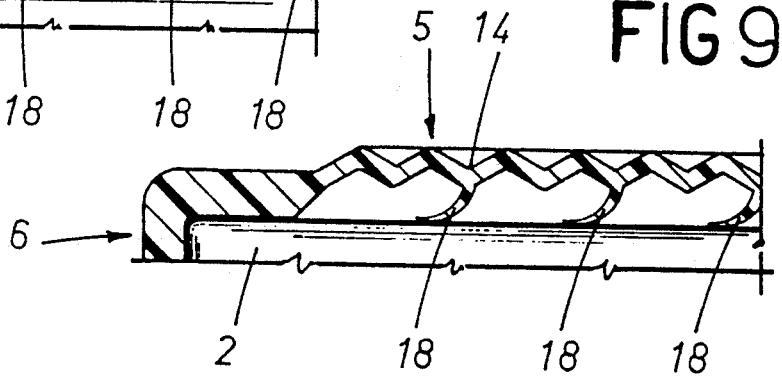

For this aim and also with the aim of better stabilising the instrument between the sides of the jacket 1, one or more flexible flaps 18 can be provided internally to the said sides 5 (see FIGS. 8 and 9), which flaps 18 project towards the inside of the jacket 1 and are preferably inclined with respect to the longitudinal centre line of the jacket 1. The above-mentiond flaps 18 can be of one piece with the jacket 1 and be obtained during the pressing operation.

Windows or slits 9 and 10 are cut into the inferior wall 8 and preferably develop parallel to the sides 5 and respectively to the end walls 6 of the jacket 1.

When the jacket 1 is used to cover an instrument having dimensions somewhat larger than those of the inside of the jacket 1, the said slits 9 and 10 stretch elastically and reduce the tension on the other walls, which tension is due to the elastic reaction of the deformed material on the insertion of the remote control unit into the jacket 1; in this way the wrapping of the jacket 1 around the remote control unit is achieved without undesired deformation of the most compliant portions of the jacket 1, on which such tensions would would normally act, especially in proximity to the edge 12 of the opening 3 in the superior wall 4, through which the instrument is inserted into the jacket 1.

Figure 6:
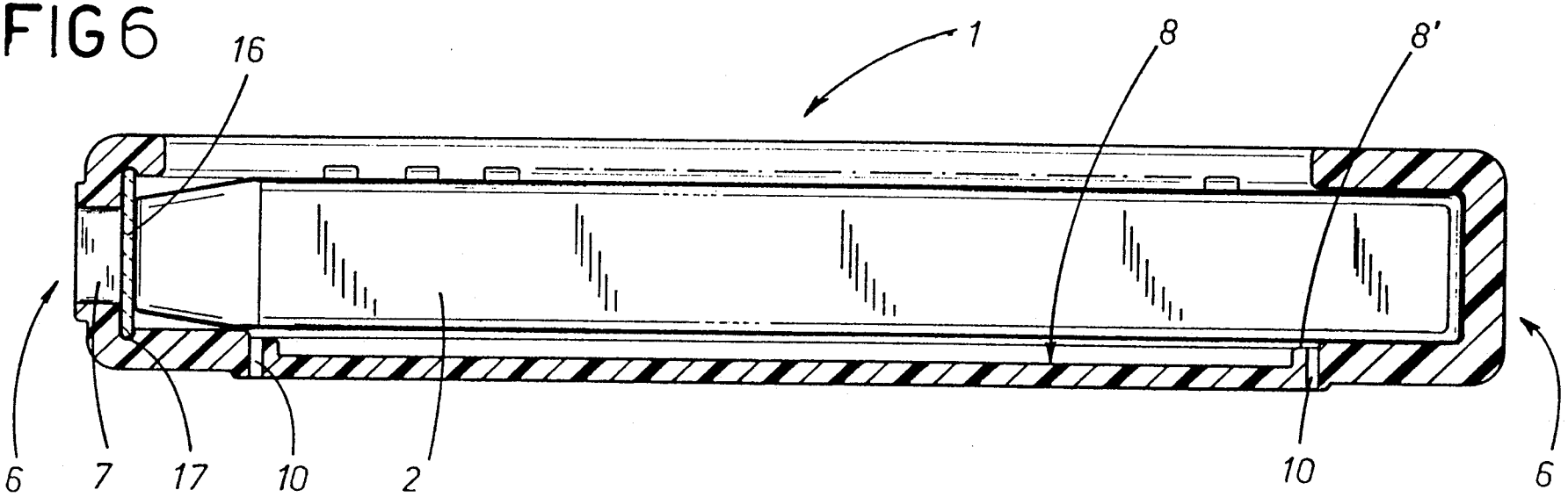
FIG. 6 illustrates the jacket in longitudinal section according to line VI—VI of FIG. 1 and according to an embodiment variant which can be effected in the case of instruments or portable remote control units with one end substantially cusp-shaped or in any case tapered.

The slits 9 and 10 can be closed up with a thin film in the same material as the jacket 1 and produced during the pressing of the same, the said film being of no importance as far as the reasons for having the said slits 9 and 10 are concerned. Further, with the aim of avoiding splits during the elastic extension phase of the jacket 1, the edges of the said slits 9 and 10 can have slightly reinforcing swellings and thus no sharp edges. According to a preferred embodiment of the invention and once again in order to avoid unwanted deformation, the edge 12 around the opening 3 can have a reinforcement swelling which contributes to greatly limiting, at least with regard to the longitudinal sides, the effects of the said elastic reaction of the material due to the insertion of the instrument in the jacket 1. In order to avoid any eventual difficulty caused by the said swelling with respect to accessibility to the command buttons situated on the instrument panel and nearest to the said edge 12, the edge 12 exhibits, in section, a back draft going from the outside towards the inside, as illustrated in FIG. 5. Still according to a preferred embodiment, the body of the jacket 1, at the sides 5 which connect its two ends destined to wrap elastically around the ends of the instrument, has a thickness in the stretchable areas which is less than that of the said ends. Furthermore, the intermediate part of the inferior wall 8 is less thick than the peripheral frame 8' in which the slits 9 and 10 are made: this favours to the full the stretchability of the body of the jacket 1. In the case herein described, at least one end wall 6 of the jacket 1 exhibits a second opening 7, necessary to permit the transmitting of signals emitted by the remote control device to the outside (see, for example, FIG. 9). In this case the use of a particularly elastic material, in particular for cusp-headed or tapered remote control units, could bring about an unwanted deformation of the said end wall 6 due to the interaction of the said cusp-shaped head on a small part of the head of the jacket 1 enveloping the said second opening 7. In this case, and according to a possible embodiment of the jacket 1 object of this invention, illustrated in FIG. 6, at the said second opening 7 a flat element 16 is envisaged, which flat element 16 is bend-resistent but transparent to the signals or impulses emitted by the instrument and interpositionable between the end of the said instument which emits the signals and substantially the entire surface of the internal face of the wall of the end walls 6 in which the said second opening 7 is present.

This rigid and substantially flat element 16, which can be made in plexiglas or similar materials, distributes evenly the reaction of the jacket 1 body over all of the internal periphery of the end wall 6 in contact with it, which reaction is consequent to the elastic deformation necessary for the introduction of the instrument into the jacket 1 itself.

For the stable positioning of the said flat element 16, the jacket 1 has a peripheral groove 17 sunk during the pressing phase into the internal surface of the end wall 6, into which peripheral groove 17 the peripheral edge of the said flat element 16 can be inserted by means of elastic deformation of the parts of the jacket 1 near to the said peripheral groove 17.

Figure 7:
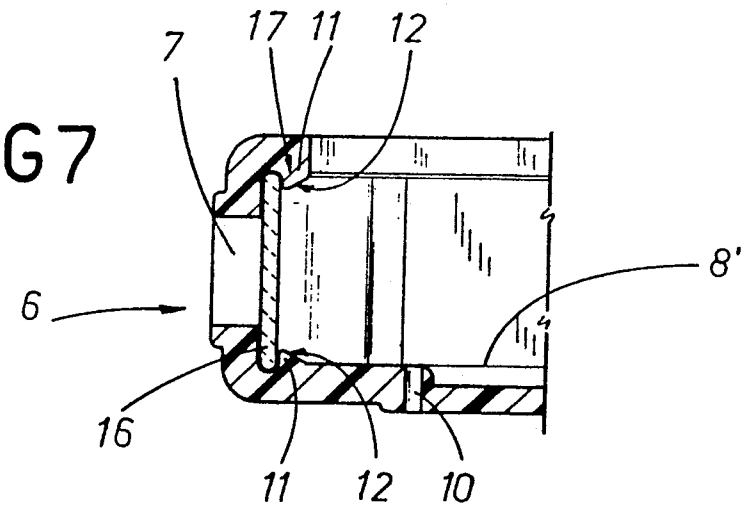
FIG. 7 illustrates, partially and in longitudinal section, the head of the jacket illustrated on the left in FIG. 6 according to a further possible embodiment.

According to a further embodiment (see FIG. 7), the peripheral groove 17 can be obtained during the forming phase of the jacket 1 between the said internal surface of the end wall 6 having the second opening 7 and one or more ridges 11 facing the said internal surface.

The said ridges 11 have a substantially saw-tooth section and their side nearest the end wall 6 is parallel to it. With this conformation it is possible to introduce the flat element 16 into the peripheral groove 17 by sliding it up the inclined faces of the ridges 11.

As indicated above, the jacket 1 can be made by pressing of an open-celled material, for example polyeurethane.

It has been shown experimentally that a material which is particularly suited for the jacket 1 is microcellular polyeurethane pressed with 0.4 g/cm$^3$ pressing density; the choice of the components, taken from the isocyanates and the polyhydric alcohol families, for the polyeurethane is important in order to obtain the following mechanical characteristics for the body of the jacket 1:

hardness of the pressed object, Shore A from 3 to 70;
maximum tensile stress from 6 to 50 kg/cm$^2$;
stretching from 200 to 250%;
tearing resistence from 1.2 to 6 kg/cm;
abrasion (DIN 53516) from 350 to 150 g.;
compressive strength from 0.4 to 7.5 kg/cm$^2$;

Thanks to these characteristics, together with those deriving from its actual structure, the jacket 1 object of the invention is easily elastically stretchable lengthwise, widthwise and heightwise and can be used for remote control units or instruments of differing shapes and sizes.

Obviously in practice all of the above-described details could be substituted by technically equivalent elements or materials. For example, especially the slits 10 could be elliptical in shape, or circular or polygonal. Also the slits 9 and 10 could be substituted by a succession of small windows or holes providing practically the same technical effect as the slits herein-described and illustrated. The above-mentioned holes could be arranged in two close lines with those in one of the lines being intercalated between those of the nearby lines.

What is claimed:

1. A shock-proof protective jacket housing a portable remote-control unit of the single-body type, said jacket being made from an elastomer material and having six walls, one of which is a top wall with a large window for insertion of a remote control unit therethrough and for external access to said unit, a bottom wall, two end walls and two lateral side walls defining the jacket, wherein the bottom wall comprises one or more slits in proximity to at least one other wall, wherein each slit reduces the tension on the other walls resulting from an elastic reaction of the jacket material deformed by the insertion of the unit into the jacket.

2. A protective jacket as in claim 1, characterized by the fact that in one or more portions of said lateral side walls, or in a whole intermediate part of said lateral side walls comprised between the two ends of the jacket, and in one or two contiguous portions of the top wall and the bottom wall, there are areas of greater thickness connected and alternated with areas of lesser thickness.

3. A jacket as in claim 1, characterized by the fact that in one or more portions of the lateral side walls or in a whole intermediate part of said side walls comprised between the two ends of the jacket, and in one or more contiguous portions of the top wall and the bottom wall, there is a longitudinal section conformed in a bellows shape.

4. A jacket as in claim 1, wherein the edge of the window and the edge of each slit exhibits a swelling or reinforcement along at least its longer sides, and characterized by the fact that said edges are not sharp.

5. A jacket as in claim 4, wherein said window edge exhibits in section a back draft going from the outside towards the inside, and wherein said edge is relatively thinner at its outside than its inside.

6. A jacket as in claim 1, wherein each slit is closed by a thin film of the same material as the jacket itself, which film is obtained during a production by forming of the said jacket.

7. A jacket as in claim 1, wherein said side walls include stretchable areas of lesser thickness than a thickness of the end walls of the jacket.

8. A jacket as in claim 1, wherein said bottom wall has an intermediate part that is of lesser thickness than a perimetral frame of said bottom wall, which frame is connected with the side walls of the jacket and that each slit is made in said intermediate part.

9. A jacket as in claim 1, characterized by the fact of having in at least one of its two end walls an opening for the transmission to the outside of a signal emitted by a remote control unit housed in said jacket.

10. A jacket as in claim 9, wherein a flat element is provided at each said opening, which flat element is resistant to bending and transparent to the signal emitted by said unit, said flat element stably interpositionable between the adjacent end of said unit and substantially the peripheral part of an internal surface of the adjacent end wall.

11. A jacket as in claim 10, characterized by the fact that it exhibits a peripheral groove sunk into an internal surface of each end wall exhibiting a said opening and destined to hold in place the correspondence flat element at a perimetrical edge.

12. A jacket as in claim 10, characterized by the fact that, for the stable positioning of each flat element, ridges are provided inside the jacket and are arranged facing the internal surface of each end wall exhibiting a said opening, said ridges having a substantially tooth-shaped cross-section appearance and having a face which is closest to the end wall parallel to it.

13. A jacket as in claim 1, characterized by the fact that it exhibits on an internal surface of its sides at least one flap projecting towards the inside of said jacket for a short distance, said at least one flap preferably being inclined with respect to the longitudinal centre-line of the jacket.

14. A jacket as in claim 1, wherein each slit exhibits a geometrical shape.

15. A jacket as in claim 1, wherein said one or more slits are comprised of a number of openings aligned in one or more lines.

16. A jacket as in claim 1, characterized by the fact that said elastomer material comprises a microcellular polyurethane pressed with 0.4 g/cm$^3$ pressing density; the choice of the components, taken from the isocyanates and the polyhydric alcohol families, in order to obtain the following mechanical characteristics for the body of the jacket:

hardness of the pressed object, Shore A from 3 to 70;
maximum tensile stress from 6 to 50 kg/cm$^2$;
stretching from 200 to 250%;
tearing resistance from 1.2 to 6 kg/cm;
abrasion (DIN 53516) from 350 to 150 g.;
compressive strength from 0.4 to 7.5 kg/cm$^2$.

17. A remote control instrument shock-proof protective jacket comprising a casing having a top wall, a bottom wall, two side walls and two end walls, said casing comprised substantially of an elastomer material, said top wall including at least one large window, said bottom wall including at least one slit in proximity to at least one side wall or one end wall.

* * * * *